US005492525A

United States Patent [19]

Gibney

[11] Patent Number: 5,492,525

[45] Date of Patent: Feb. 20, 1996

[54] EXERCISE DEVICE FOR TREATING CARPAL TUNNEL SYNDROME

[76] Inventor: Joel Gibney, 6 Harbor Way, Ste. 258, Santa Barbara, Calif. 93109

[21] Appl. No.: 293,702

[22] Filed: Aug. 22, 1994

Related U.S. Application Data

[63] Continuation-in-part of Ser. No. 711,079, Jun. 6, 1991, Pat. No. 5,366,436.

[51] Int. Cl.[6] ..... A61H 1/00; A63B 23/16

[52] U.S. Cl. ..... 601/40; 482/44; 482/48; 248/118.5; 248/918

[58] Field of Search ..... 482/44, 47, 48; 248/118.5, 918, 118, 118.1, 23; 601/40

[56] References Cited

U.S. PATENT DOCUMENTS

| | | | |
|---|---|---|---|
| 3,482,569 | 12/1969 | Raffaelli, Sr. | 602/62 X |
| 3,612,521 | 10/1971 | Wendeborn | 482/48 |
| 4,176,473 | 12/1979 | Rae | 446/147 X |
| 4,365,438 | 12/1982 | Nelson | 446/75 |
| 4,815,729 | 3/1989 | Stefanski | 482/48 |
| 4,828,249 | 5/1989 | Keating | 482/48 |
| 4,988,321 | 1/1991 | Goldfarb | 446/75 |
| 5,013,030 | 5/1991 | Frins | 487/47 |
| 5,062,625 | 11/1991 | Vonk | 482/48 |
| 5,120,010 | 6/1992 | Magee | 248/118 |
| 5,197,699 | 3/1993 | Smith et al. | 248/118 |
| 5,366,436 | 11/1994 | Gibney | 601/40 |

FOREIGN PATENT DOCUMENTS

| | | | |
|---|---|---|---|
| 568609 | 4/1945 | United Kingdom | 482/48 |

*Primary Examiner*—Robert A. Hafer
*Assistant Examiner*—Brian E. Hanlon
*Attorney, Agent, or Firm*—Michael G. Petit

[57] ABSTRACT

An exercise device and method for the treatment of symptoms related to carpal tunnel syndrome is described. The device comprises an elastic member, retained in a mouse pad, which removably attaches to the distal tips of the fingers and the thumb of the affected hand. The patient dons the device and with the fingers and thumb extended, repetitively forces the fingers and thumb outward away from one another against the elastic restoring force of the device. Brief, frequent, (preferably daily) use of this device relieves the symptoms of carpal tunnel syndrome.

1 Claim, 3 Drawing Sheets

EXERCISE DEVICE FOR TREATING CARPAL TUNNEL SYNDROME

This application is a continuation-in-part of U.S. patent application Ser. No. 07/711,079 filed Jun. 6, 1991 now U.S. Pat. No. 5,366,436.

BACKGROUND OF THE INVENTION

1. Field of the Invention

This invention relates to a device for the treatment of symptoms associated with carpal tunnel syndrome.

2. Background and Prior Art

The complex of symptoms resulting from compression of the median nerve in the carpal tunnel is referred to as carpal tunnel syndrome.

A cross-section of the carpal tunnel, (indicated at 20 in FIG. 2) demonstrates the vulnerability of the median nerve. The carpal bones which are tightly bound together form the dorsal medial and lateral walls of the tunnel. These bones are joined anteriorly by the transverse carpal ligament, a dense, non-resilient structure. The carpal tunnel contains the median nerve as well as nine flexor tendons and their tendon sheets.

A number of conditions such as obesity or pregnancy can increase the contents or decrease the size of the carpal tunnel and thereby compress the median nerve. Anomalous over-developed muscles may also compress the median nerve. Similarly, any condition that produces edema in the hand and wrist may cause or accentuate carpal tunnel compression.

The most common pathologic finding among patients with carpal tunnel syndrome is non-specific tenosynovitis. This condition is characterized by thickening of the tenosynovium, which increases the volume of the structures within the carpal tunnel thereby compressing the median nerve. A non-specific thickening of the tenosynovium is the most common cause of carpal tunnel syndrome. A patient with carpal tunnel syndrome usually first complains of pain and numbness in the fingers of one hand. At times, a patient may complain of pain extending into the forearm or even the upper arm or shoulder. The discomfort can range from mild to excruciating. If carpal tunnel syndrome has been present for several months or years, patients may also complain of clumsiness and weakness in the hand which makes it difficult for them to pick up and hold small objects. These symptoms often result from atrophy of the thenar muscles; these muscles are supplied by the motor branch of the median nerve.

If carpal tunnel symptoms are mild and of short duration (2 or 3 months), conservative treatment is usually recommended. This is particularly true when the symptoms are expected to disappear in the foreseeable future (e.g., termination of pregnancy or change of occupation). Conservative treatment includes medications such as non-steroidal anti-inflammatory drugs, steroids or diuretics, immobilization and steroid injection of the wrist. Elsey, in U.S. Pat. No. 4,854,309 (col 1, lines 11–16) suggests that exercise can be used to overcome problems associated with carpal tunnel syndrome. Unfortunately, no examples of such exercises are presented. The patent teaches the use of a wrist splint to treat the symptoms of carpal tunnel syndrome.

Non-operative treatment may provide early symptomatic relief of carpal tunnel syndrome, but often fails to give protracted benefit. This is particularly true for the individual whose job requires constant repetitive wrist and hand activities. Surgical treatment is indicated when nonoperative management is ineffective and symptoms are of sufficient severity to warrant surgery. Surgical intervention involves dissection of the transverse carpal ligament. The incision may cause injury to one or more of the small cutaneous branches of the median nerve which can result in neuroma formation or a painful hypertrophic scar. Anomalies of the median nerve are not uncommon and small incisions that will require blind dissection to decompress the nerve are fraught with significant potential complications. The complications of surgery have been documented (for a summary of complications, see, for example, "Complications of Surgical Release for Carpal Tunnel Syndrome," Rodney McDonald et al Journal of Hand Surgery, Vol. 3, No. 1 pg. 70 (1978) and include imcomplete division of the transverse carpal ligament, damage to the palmar cutaneous branch of the median nerve, palmar hematoma, and other nerve injuries.

In view of the foregoing complications of surgery, it is desirable that a device and method for treating symptoms of carpal tunnel syndrome which is both conservative and applicable towards both early and more advanced states of the syndrome should be available. Greenfield, in U.S. Pat. No. 4,750,734, teaches the construction and use of a hand exerciser. The exerciser generally comprises a regular array of openings in planar elastic member through which openings the fingers and thumb may be inserted. The fingers may be moved relative to one another against the resistance of the elastic member to exercise various muscle groups. Greenfield's device has a stiff or rigid circumferential border. This is necessary for performing exercises requiring flexion of the fingers. The rigid outer border prevents folding of the device and substantially reduces its portability in, for example, a purse or pocket.

Williams, in U.S. Pat. No. 4,730,827 describes a similar exercise device comprising a disk-like member provided with recesses in its periphery and at least one aperture for the thumb. The device has the capability of either individually or simultaneously exercising or manipulating all digits of a patient's hand thereby strengthening the muscles and tendons. Surprisingly, until now it has not been recognized that a particular set of exercises as will be described below may be performed on hand exercising devices similar to the prior art devices above to provide relief for the symptoms of carpal tunnel syndrome.

DESCRIPTION OF THE PREFERRED EMBODIMENT

Figure 1:
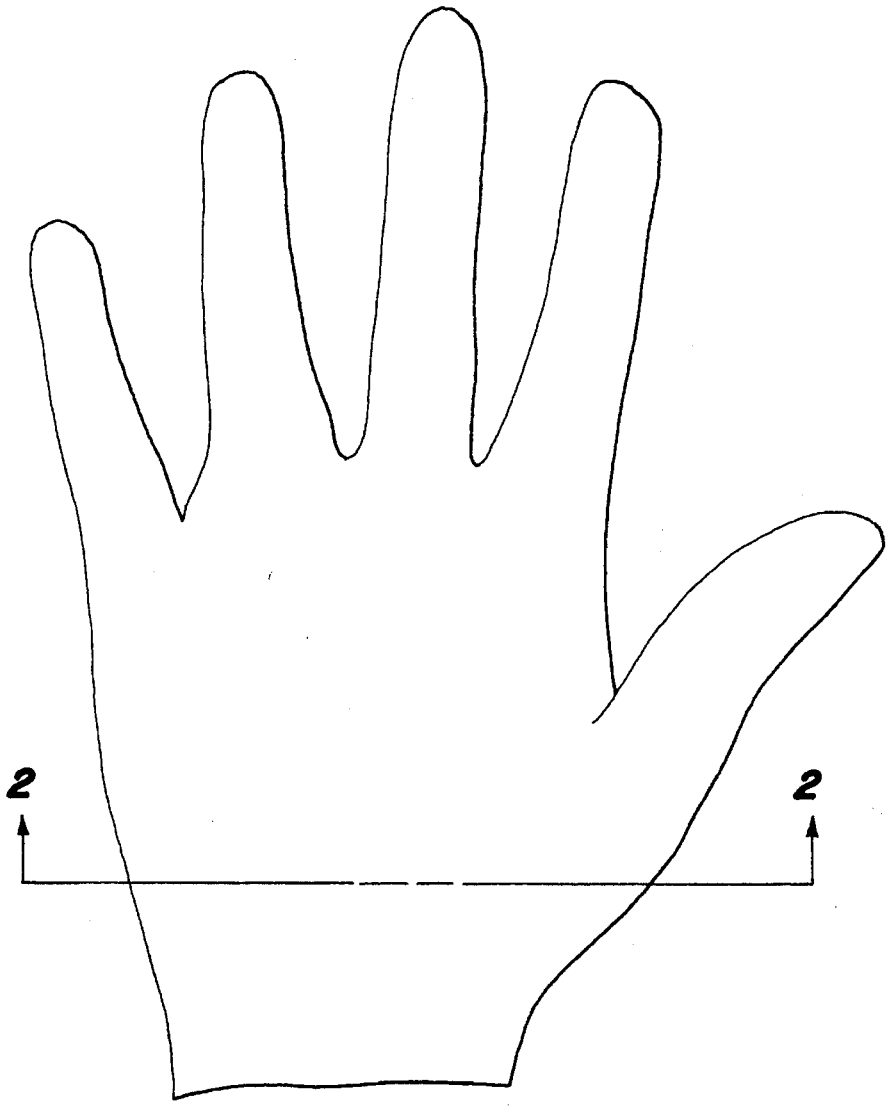
FIG. 1 is a plan view of the hand looking down upon the palm of the right hand.
Figure 2:
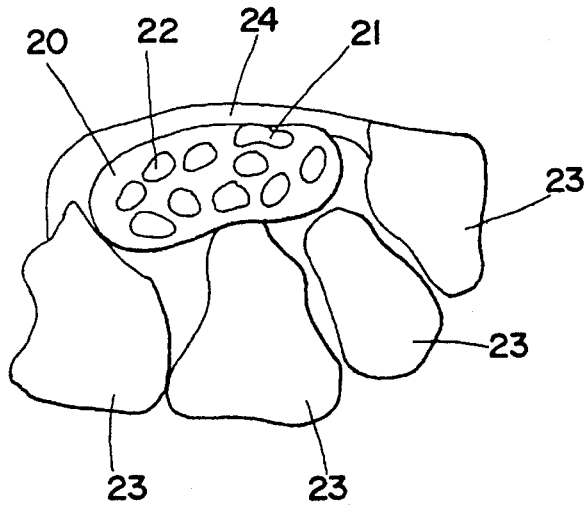
FIG. 2 is a cross-section of the hand of FIG. 1 taken along line 22.

Turning now to FIG. 2 the anatomy of the carpal tunnel 20 and surrounding anatomical structures is shown. The four carpal bones 23 form the floor of this rigid tunnel. The roof of the tunnel consists of the transverse carpal ligament 24 which is a non-elastic structure. The tunnel contains nine flexor tendons 22 as well as the median nerve 21. It is seen that the median nerve 21 and nine flexor tendons 22 all lie entirely within and pass through the carpal tunnel generally indicated at 20. Any condition that alters the amount of space within the carpal tunnel may result in median nerve compression. For example, if one of the carpal bones 23 encroaches on the carpal tunnel, it may produce secondary compression of the median nerve. Thickening of the tendon sheaths surrounding the tendons 22 within the carpal tunnel will decrease the space within the tunnel and thereby impinge or bear upon the median nerve. Median nerve compression can also result if osseous particles or other lesions are present within the carpal tunnel.

Figure 3:
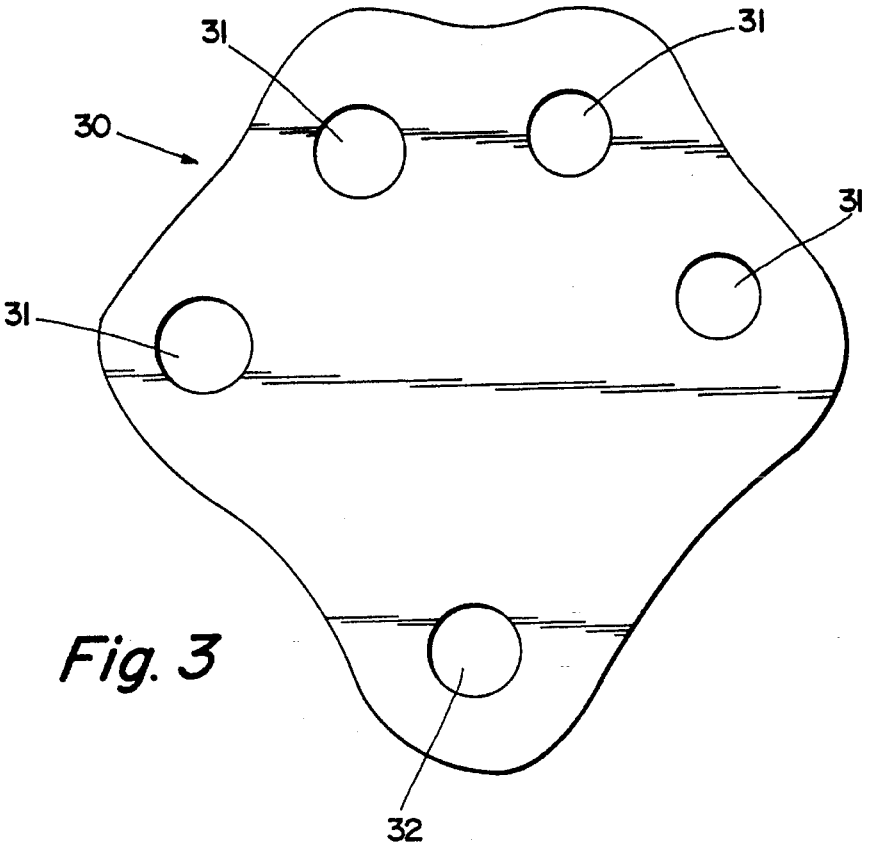
FIG. 3 is a plan view of the device of the present invention.

Turning now to FIG. 3, we see a plan view of a preferred embodiment of the device generally indicated at 30. The preferred embodiment of the device is made in a single piece from a homogeneous elastomeric material such as silicone, latex, polyurethane, or copolymers thereof. Attachments for the fingers 31 and thumb 32 are positioned around the periphery of the device. The finger holes 31 and thumb holes 32 (or recesses within the periphery) can be conveniently made in a mold or simply stamped or punched out of a sheet of expandable material.

Figure 4:
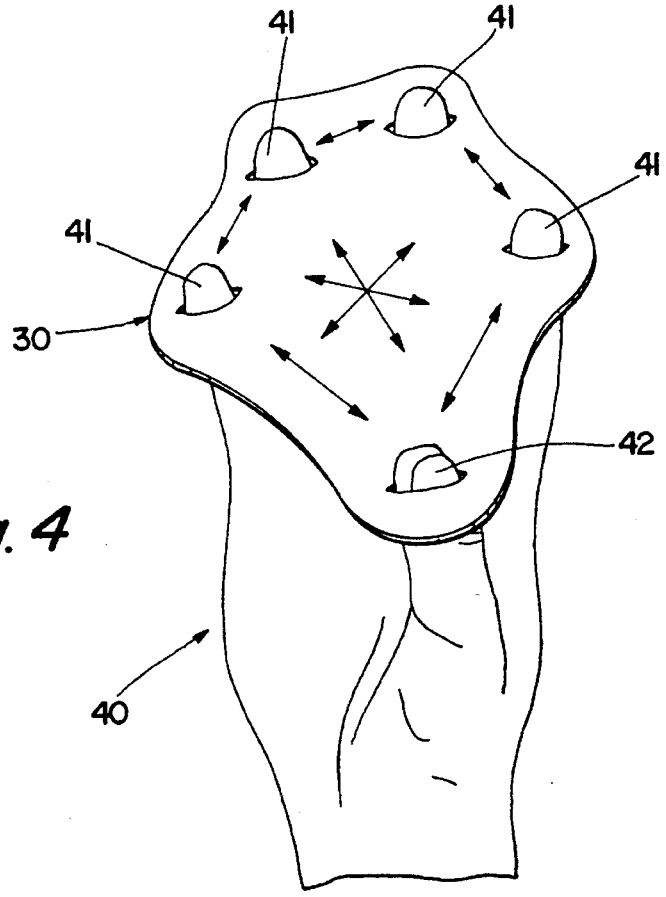
FIG. 4 shows the device being used for the treatment and prevention of carpal tunnel syndrome.

Turning now to FIG. 4, we see the device 30 of FIG. 3 on the hand 40 of a patient being treated for carpal tunnel syndrome. Repetitive extension of the fingers 41 and thumb 42 in the direction of the arrows against the resistance of the device for approximately five minutes twice daily gives immediate relief from the pain of carpal tunnel syndrome. While it remains unclear exactly how the device works, it is probable that the repetitive exercise strengthens the extensor muscles thereby or pulling the carpal bones away from the transverse carpal ligament and enlarging the carpal tunnel thereby reducing the pressure on the median nerve.

Figure 5:
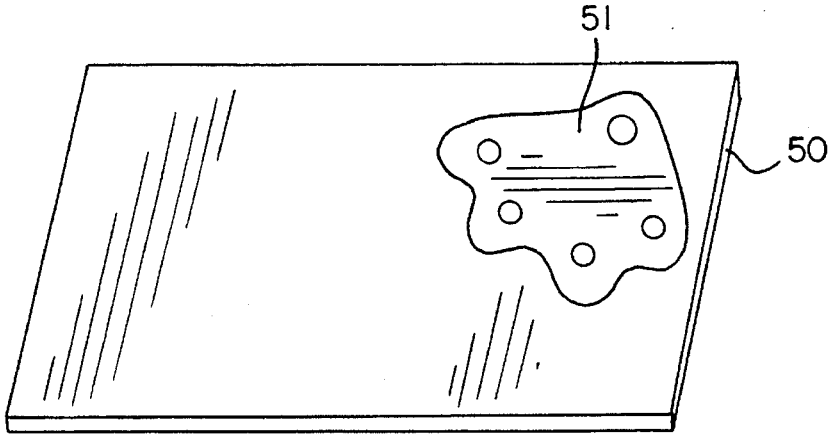
FIG. 5 is a perspective view of an embodiment of the invention wherein a removable portion of a mouse pad for computer operators may be removed and used to perform exercises for preventing and/or relieving the symptoms of carpel tunnel syndrome.
Figure 6:
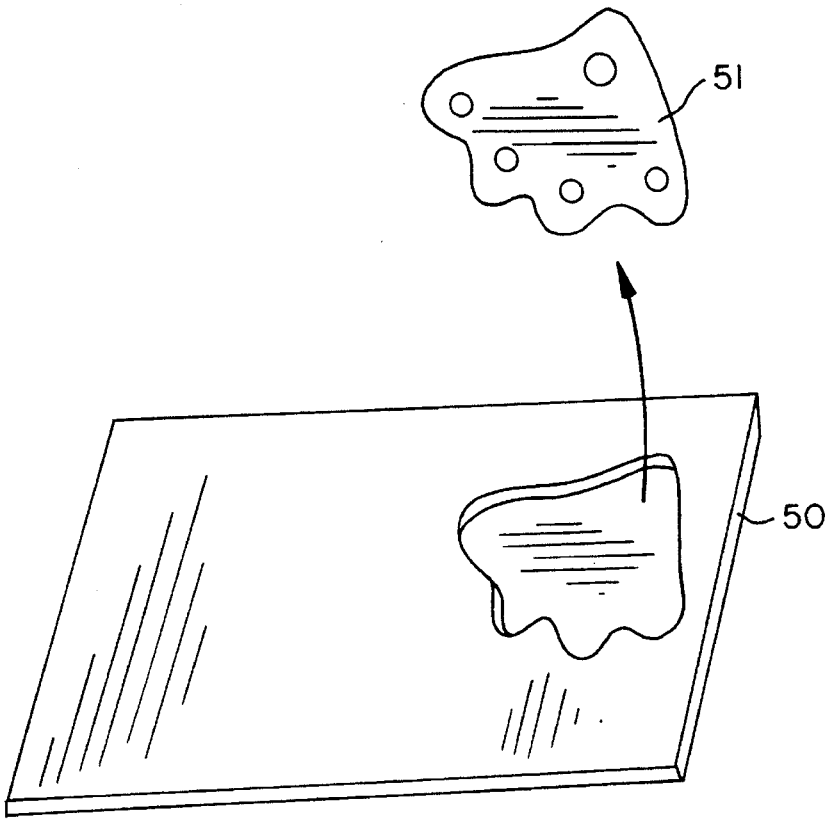
FIG. 6 shows the device of the present invention in removable relationship to the mouse pad of FIG. 5.

There is a high incidence of carpal tunnel syndrome in keyboard operators. A further embodiment of the present invention is shown in FIGS. 5 and 6. A mouse pad of a type employed with the computer input device commonly referred to as a "mouse" is shown at 50 in FIG. 5. A portion 51 of the mouse pad 50 is die cut in the shape of the device 30 shown in FIG. 3. The device 51 can be removed from the mouse pad 50 to perform the set of exercises in accordance with FIG. 4 then reinserted in the mouse pad 50. If the device 51 is die cut in one of the comers of the pad there is minimum interference with the operation of a mouse thereon. An important feature of all embodiments of the device of the present invention is that it is a flexible planar sheet of elastomeric material having a soft, flexible periphery which facilitates folding or rolling for compact transport.

In cases where carpal tunnel syndrome results from over-use of flexing muscles of the hand, the device strengthens the extensor muscles thereby providing a balancing of opposing muscle groups. While it is preferable to fully extend the fingers prior to abduction, it is also possible to effect relief and prevention by repetitively extending the digits of the hand against the elastic restoring force of the device.

The foregoing embodiments are exemplary and included to provide instruction in the use of the invention. Many modifications of these embodiments are possible and obvious. The expandable member may be fabricated of any material having suitable elasticity and the device may be used for treating symptoms arising from over-use of the flexor muscles of the hand and general rehabilitation. The scope of the invention is not to be limited to the particular embodiment described herein. For example, the elastic member may have slits placed therein or material removed therefrom to vary the restoring force on the fingers during extension thereof. Instead, the scope of the invention should be interpreted in accordance with the scope of the claims appended hereto.

What I claim is:

1. A mouse pad for a computer mouse being operable for moving a cursor on a computer screen when moved against an upper surface of the mouse pad, said mouse pad comprising a flat sheet of elastomeric material having an upper surface and a lower surface, and wherein a portion of said mouse pad comprises a hand exercise portion, said hand exercise portion being removable from said mouse pad and further comprising a planar elastomeric sheet having an upper surface and a lower surface which are coextensive with a portion of the corresponding upper and lower surfaces on said mouse pad said hand exercise portion being deformable when removed from said flat sheet and having at least five holes connecting said upper surface and said lower surface wherein said at least five holes are dimensioned to accommodate the fingers and thumb of a hand.

* * * * *